US009959726B2

(12) United States Patent
Kurtz et al.

(10) Patent No.: US 9,959,726 B2
(45) Date of Patent: May 1, 2018

(54) SYSTEM AND METHOD OF AIRFLOW MONITORING FOR VARIABLE AIRFLOW ENVIRONMENTS

(71) Applicant: Honeywell International Inc., Morristown, NJ (US)

(72) Inventors: Edward J. Kurtz, Saint Charles, IL (US); Scott R. Lang, Geneva, IL (US)

(73) Assignee: HONEYWELL INTERNATIONAL INC., Morristown, NJ (US)

( * ) Notice: Subject to any disclaimer, the term of this patent is extended or adjusted under 35 U.S.C. 154(b) by 55 days.

(21) Appl. No.: 14/547,499

(22) Filed: Nov. 19, 2014

(65) Prior Publication Data

US 2016/0140822 A1 May 19, 2016

(51) Int. Cl.
*G08B 17/10* (2006.01)
*G08B 29/04* (2006.01)

(52) U.S. Cl.
CPC ..... *G08B 17/10* (2013.01); *G08B 29/043* (2013.01)

(58) Field of Classification Search
None
See application file for complete search history.

(56) References Cited

U.S. PATENT DOCUMENTS

2004/0217857 A1* 11/2004 Lennartz ..... G08B 29/145 340/514
2004/0257235 A1* 12/2004 Right ..... F24F 11/0086 340/628
2005/0030172 A1 2/2005 Right et al.
2012/0053859 A1* 3/2012 Liu ..... G01R 31/2817 702/45
2013/0238138 A1* 9/2013 Cole ..... G08B 17/10 700/275
2013/0261808 A1* 10/2013 Besore ..... F24F 11/0015 700/278
2015/0065030 A1* 3/2015 Kates ..... G01N 33/0065 454/257

FOREIGN PATENT DOCUMENTS

EP 0 696 787 A1 2/1996
EP 2 407 946 A1 1/2012

OTHER PUBLICATIONS

Extended European search report from corresponding EP patent application 15194171.3, dated Mar. 24, 2016.
English-language abstract of EP patent application 0 696 787 A1, dated Feb. 14, 1996.
English-language abstract of EP patent application EP 2 407 946 A1, dated Jan. 18, 2012.

* cited by examiner

*Primary Examiner* — Fabricio R Murillo Garcia
(74) *Attorney, Agent, or Firm* — Husch Blackwell LLP

(57) ABSTRACT

A method of operating an aspirated smoke detector includes providing an ambient condition detector, establishing a first flow baseline for the detector, establishing a second, lower, flow baseline for the detector, sampling a selected airflow, and determining if the slected airflow as sampled should be compared to the first flow baseline or the second, lower, flow baseline, and responsive thereto, determining if a trouble indictor should be generated.

11 Claims, 2 Drawing Sheets

SYSTEM AND METHOD OF AIRFLOW MONITORING FOR VARIABLE AIRFLOW ENVIRONMENTS

FIELD

The application pertains to control systems and methods for monitoring variable airflows that might impact operation of ambient condition detectors. More particularly, the application pertains to such systems and methods to improve operationality of aspirating smoke detectors in varying airflow environments.

BACKGROUND

Aspirating smoke detectors are known and useful in a variety of commercial and industrial environments. When commissioned, an aspirating smoke detector establishes an airflow baseline for the air that flows through the detector. During the operating life of the detector, current airflow is monitored and compared to the baseline that was established during commissioning. When a current airflow measurement deviates from the baseline that was established during the commissioning, a trouble condition is reported to the operator of the detector.

Aspirating smoke detectors are often used to monitor the current airflow on the return air grills for HVAC units. During operation, HVAC units may continuously cycle on and off, which can result in periods of high airflow followed by periods of stagnant air. These changes in airflow can cause the aspirating smoke detector to generate the trouble condition due to the current airflow when compared to the baseline that was established during the commissioning.

DETAILED DESCRIPTION

Figure 1:
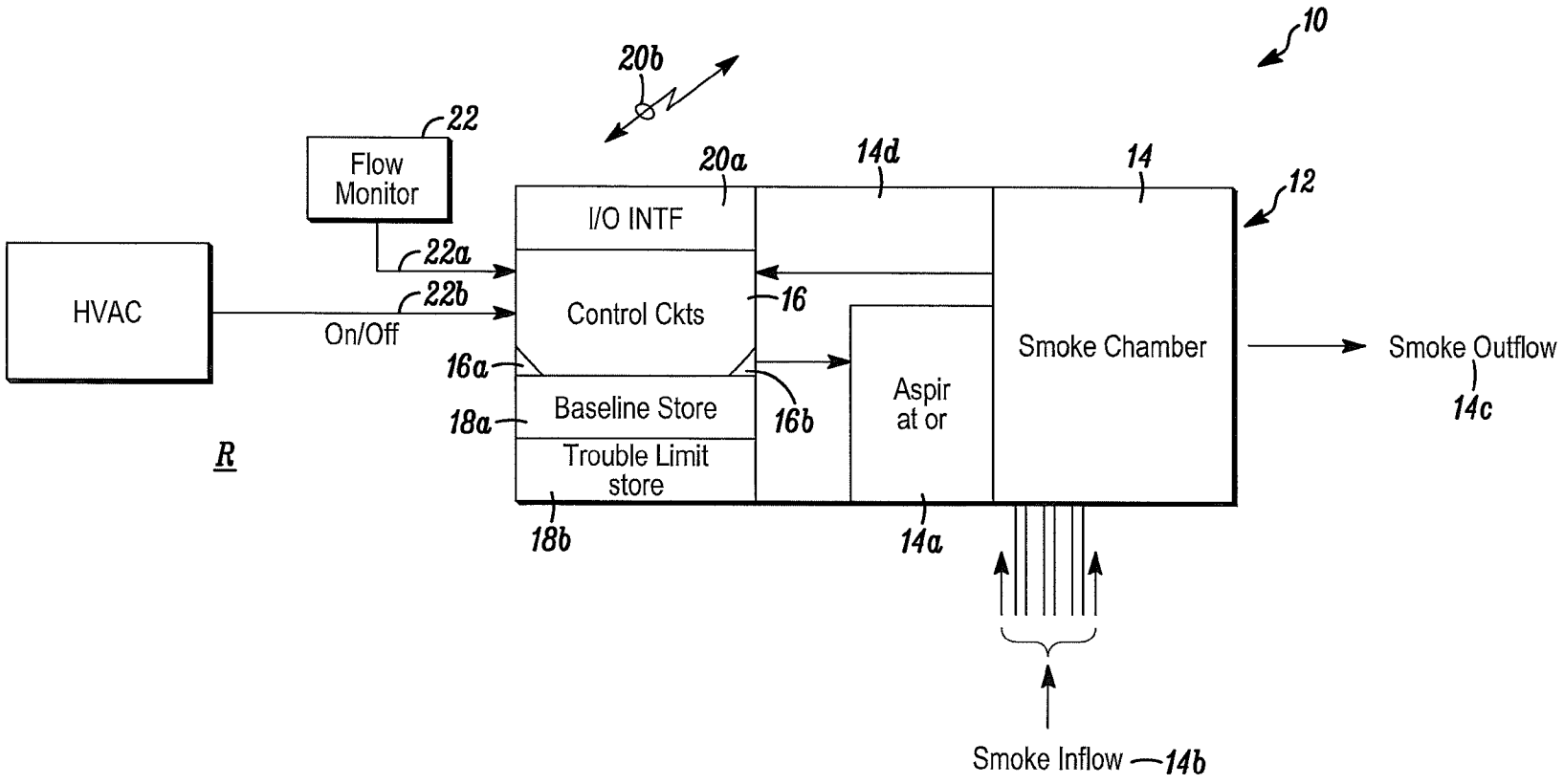
FIG. 1 is a block diagram of a system in accordance herewith.

While disclosed embodiments can take many different forms, specific embodiments thereof are shown in the drawings and will be described herein in detail with the understanding that the present disclosure is to be considered as an exemplification of the principles thereof as well as the best mode of practicing the same and is not intended to limit the application or claims to the specific embodiment illustrated.

In one aspect, embodiments hereof establish more than one baseline. For example, a first baseline for when a HVAC unit is running at its maximum velocity and a second baseline for when the HVAC unit is off would allow a device to account for large airflow changes and prevent false trouble conditions.

An aspirating smoke detector could have an input from the HVAC unit that would indicate when the HVAC unit is running, and the detector could determine which airflow baseline should be used for indicating a trouble condition if such a condition exists. Example inputs could be "airflow on," "airflow off," input from an anemometer, etc.

In yet another aspect, when initializing the device will establish two baselines, one when the HVAC unit is on and one when the HVAC unit is off. During normal operation, the device will sample current airflow and compare the current airflow to an appropriate baseline value. The device selects the baseline to which the current airflow is compared by reading the input from the HVAC unit or from an external flow monitoring sensor.

If the current airflow varies by a percentage indicative of the trouble condition, then the device will report the trouble condition.

Figure 2:
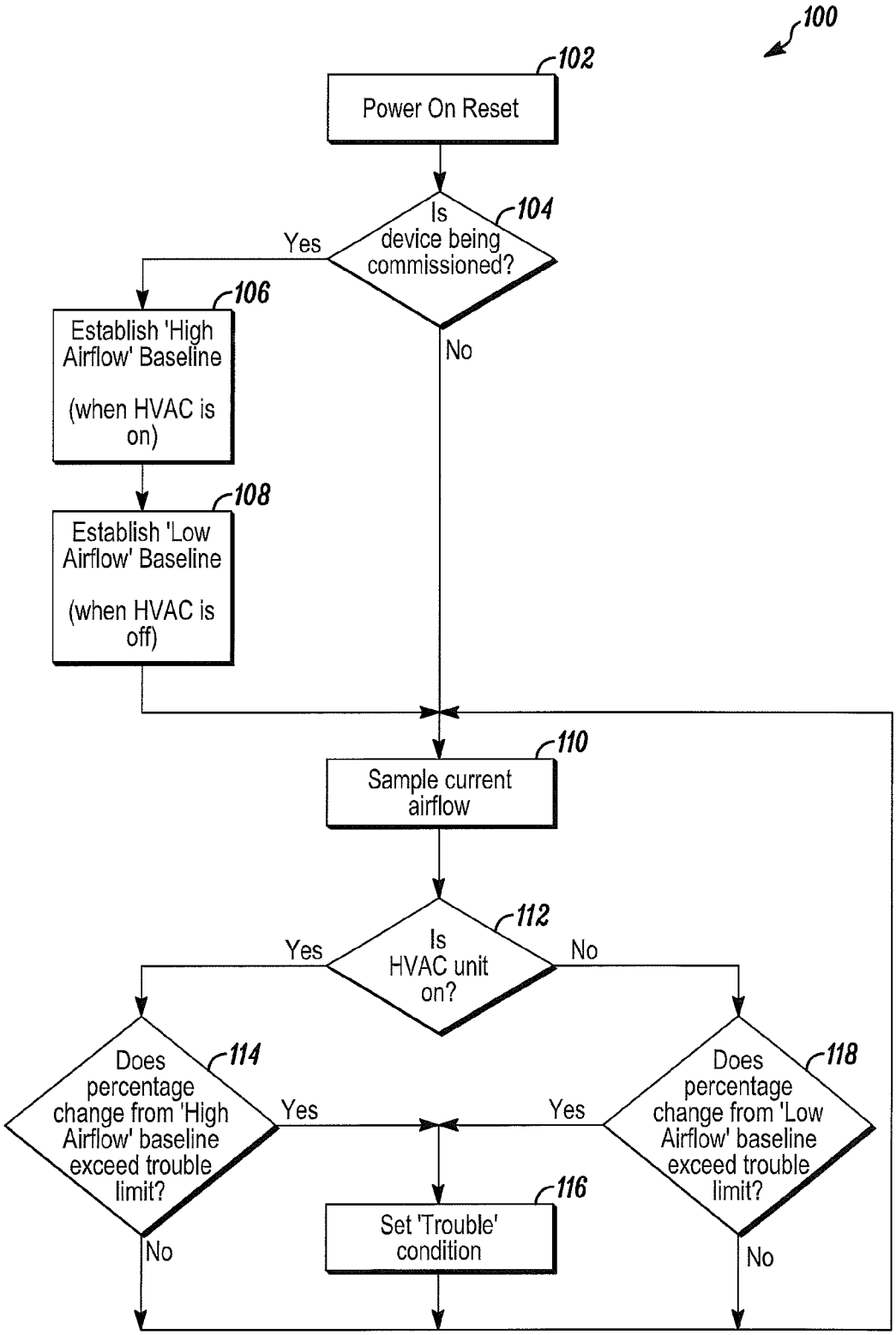
FIG. 2 is a flow diagram illustrating aspects of a method in accordance herewith.

FIGS. 1 and 2 illustrate aspects of a system 10 in accordance herewith and a method 100 in accordance herewith, respectively. The system 10 includes an ambient condition detector 12, which could be an aspirating smoke detector. The detector 12 includes a smoke chamber 14, an aspirator 14*a*, smoke inflow conduits 14*b*, and smoke outflow conduits 14*c*.

The detector 12 is coupled to control circuits 16 by an output signal line 14*d*. As those of skill will understand, the signals on the line 14*d* are indicative of smoke detected in the chamber 14.

The control circuits 16 can be implemented at least in part by one or more programmable processors 16*a* that can execute instructions 16*b* located at the detector 12.

A storage element 18*a* is coupled to the circuits 16 and provides storage for at least two different baseline values. A storage element 18*b* is also coupled to the circuits 16 and provides storage for at least one trouble limit value. The usefulness of these stored values is discussed subsequently.

A flow monitor 22 can provide output signals on a line 22*a* indicative of sensed flow in a target area or region, such as a region R. A line 22*b* can couple an on/off signal for a HVAC unit indicative of when the HVAC unit is energized and operating to provide heat, ventilation or cooling to the region R.

The system 10 can operate in a variety of modes. One operational mode is illustrated in FIG. 2 as the method 100. Initially, the detector 12 can be energized and reset, as at 102. A determination is made as to whether the detector 12 is being put into service or commissioned, as at 104. If so, then high airflow and low airflow baseline values indicative of operating states of the HVAC unit can be established, as at 106 and 108. Such values can be stored as discussed above in the storage element 18*a*. Optionally, the trouble limit value can be stored in the storage element 18*b* at this time.

Subsequently, when the detector 12 is placed to service a region, such as the region R, a current airflow is sampled, as at 110, via the flow monitor 22. A determination is made, as at 112, as to the state of the HVAC unit. An electrical signal on the line 22*b* indicative of this state can be coupled to the control circuits 16. This signal provides information as to whether the HVAC unit is energized and on or not energized and off.

If the determination is that the HVAC unit is on, then another determination is made, as at 114, as to whether a percentage change, the trouble limit value, from the high airflow baseline value exceeds a trouble limit. If so, then a trouble condition is indicated, as at 116. An indicium of this state can then be transmitted via an interface 20*a* and a medium 20*b* to a displaced monitoring or security location.

If the HVAC unit is not on, as at 112, then a determination is made, as at 118, as to whether the percentage change, the same or a different trouble limit value, from the low airflow baseline value exceeds that trouble limit. If so, then the trouble condition is indicated, as at 116.

Those of skill will understand that neither the specific details of the exemplary system 10 nor the details of the method 100 are limitations hereof except as described herein. If desired, then multiple pairs of baseline values and multiple trouble limit values can be stored in the storage elements 18*a*, 18*b* without departing from the spirit and scope hereof.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown or sequential order to achieve desirable results. Other steps may be provided, steps may be eliminated from the described flows, and other components may be added to removed from the described embodiments.

The invention claimed is:

1. An apparatus comprising:

an ambient condition detector;

first and second predetermined flow thresholds set during commissioning of the ambient condition detector;

an anemometer configured to generate a flow indicating signal; and control circuits that include an input port for receiving the flow indicating signal and a heating, ventilation, and air conditioning ("HVAC") state signal, wherein the HVAC state signal indicates whether an HVAC system is energized or not energized, wherein the flow indicating signal indicates an airflow value, wherein the control circuits compare the flow indicating signal to the first predetermined flow threshold to determine whether a signal value of the flow indicating signal varies by a first percentage from the first predetermined flow threshold when the HVAC state signal indicates that the HVAC system is not energized, wherein the control circuits compare the flow indicating signal to the second predetermined flow threshold to determine whether the signal value of the flow indicating signal varies by a second percentage from the second predetermined flow threshold when the HVAC state signal indicates that the HVAC system is energized, and wherein, responsive to comparing the flow indicating signal to one of the first and second predetermined flow thresholds, the control circuits determine if a trouble indicator should be generated.

2. The apparatus as in claim 1 wherein the first and second predetermined flow thresholds are stored in an electronic storage element that is coupled to the control circuits.

3. The apparatus as in claim 1 wherein the flow indicating signal comprises an analog signal.

4. The apparatus as in claim 3 wherein the signal value of the flow indicating signal is indicative of one of a first flow rate or a second flow rate, and wherein the second flow rate is lower than the first flow rate.

5. The apparatus as in claim 1 wherein the ambient condition detector comprises an aspirated smoke detector.

6. The apparatus as in claim 5 wherein at least one of the first and second predetermined flow thresholds is stored in an electronic storage element that is coupled to the control circuits.

7. An aspirated smoke detector comprising:

control circuits that include an input port for receiving first and second baseline indicating values set during commissioning of the aspirated smoke detector; and an anemometer that indicates a realtime flow value to the control circuits, wherein the control circuits receive a heating, ventilation, and air conditioning ("HVAC") state signal that indicates whether an HVAC system is energized or not energized, wherein the control circuits compare the realtime flow value to the first baseline indicating value to determine whether the realtime flow value varies by a first percentage from the first baseline indicating value when the HVAC state signal indicates that the HVAC system is not energized, wherein the control circuits compare the realtime flow value to the second baseline indicating value to determine whether the realtime flow value varies by a second percentage from the second baseline indicating value when the HVAC state signal indicates that the HVAC system is energized, and wherein the control circuits determine if a trouble condition is present responsive to comparing the realtime flow value to one of the first and second baseline indicating values.

8. A method comprising:

providing an ambient condition detector;

establishing a first flow baseline for the ambient condition detector during commissioning of the ambient condition detector;

establishing a second flow baseline for the ambient condition detector during the commissioning of the ambient condition detector, wherein the second flow baseline is lower than the first flow baseline;

sampling an airflow from an anemometer;

receiving a heating, ventilation, and air conditioning ("HVAC") state signal from an HVAC system, wherein the HVAC state signal indicates whether the HVAC system is energized or not energized;

comparing the airflow to the first flow baseline to determine whether the airflow varies by a first percentage from the first flow baseline when the HVAC state signal indicates that the HVAC system is not energized;

comparing the airflow to the second flow baseline to determine whether the airflow varies by a second percentage from the second flow baseline when the HVAC state signal indicates that the HVAC system is energized; and determining when a trouble indicator should be generated responsive to comparing the airflow to one of the first and second flow baselines.

9. The method as in claim 8 wherein providing the ambient condition detector includes providing an aspirated smoke detector.

10. The method as in claim 9 further comprising storing the first percentage and the second percentage in the ambient condition detector.

11. The method as in claim 10 further comprising storing the first and second flow baselines in the ambient condition detector.

* * * * *